US008511785B2

(12) United States Patent
Snyder et al.

(10) Patent No.: US 8,511,785 B2
(45) Date of Patent: Aug. 20, 2013

(54) INKJET PRINTER WITH PARTIAL IMAGE RECEIVING MEMBER HEATING

(75) Inventors: Trevor James Snyder, Newberg, OR (US); Palghat S. Ramesh, Pittsford, NY (US); Bruce Earl Thayer, Spencerport, NY (US); Paul J. McConville, Webster, NY (US)

(73) Assignee: Xerox Corporation, Norwalk, CT (US)

( * ) Notice: Subject to any disclaimer, the term of this patent is extended or adjusted under 35 U.S.C. 154(b) by 194 days.

(21) Appl. No.: 13/223,152

(22) Filed: Aug. 31, 2011

(65) Prior Publication Data

US 2013/0050327 A1 Feb. 28, 2013

(51) Int. Cl.
*B41J 29/38* (2006.01)

(52) U.S. Cl.
USPC ..... 347/17; 347/19; 347/103

(58) Field of Classification Search
USPC ..... 347/14, 16–19, 102–105; 399/69, 399/92, 96, 122, 107, 320, 328–331
See application file for complete search history.

(56) References Cited

U.S. PATENT DOCUMENTS

| | | | | |
|---|---|---|---|---|
| 3,649,992 | A | | 3/1972 | Thettu |
| 4,563,073 | A | | 1/1986 | Reynolds |
| 5,367,322 | A | * | 11/1994 | Sogami et al. ..... 347/213 |
| 5,436,712 | A | | 7/1995 | Wayman et al. |
| 5,602,635 | A | | 2/1997 | Domoto et al. |
| 5,774,763 | A | | 6/1998 | Muramatsu |
| 5,788,382 | A | | 8/1998 | Egbert et al. |
| 5,933,695 | A | | 8/1999 | Henry et al. |
| 6,241,344 | B1 | | 6/2001 | Machida |
| 7,236,732 | B2 | | 6/2007 | Cao et al. |
| 7,725,050 | B2 | | 5/2010 | Li et al. |
| 2004/0060921 | A1 | | 4/2004 | Justice et al. |
| 2006/0188280 | A1 | | 8/2006 | Hayakawa et al. |
| 2007/0024687 | A1 | | 2/2007 | Park et al. |
| 2009/0219328 | A1 | | 9/2009 | Godil et al. |
| 2010/0135686 | A1 | | 6/2010 | Li et al. |

* cited by examiner

*Primary Examiner* — Juanita D Jackson
(74) *Attorney, Agent, or Firm* — Maginot, Moore & Beck, LLP

(57) ABSTRACT

A method for operating an image receiving member in a phase change ink printer has been developed. The method includes selectively rotating the image receiving member past an activated heater to heat a first portion of the image receiving member to a first predetermined temperature that is greater than a second temperature to which a remaining portion of the image receiving member is heated by the heater.

24 Claims, 6 Drawing Sheets

INKJET PRINTER WITH PARTIAL IMAGE RECEIVING MEMBER HEATING

TECHNICAL FIELD

This application is directed to imaging devices having heated image receiving members in general, and, more particularly, to rotating image receiving members that are heated to a predetermined temperature prior to receiving ink images.

BACKGROUND

Drop on demand inkjet printing systems eject ink drops from printhead nozzles in response to pressure pulses generated within the printhead by either piezoelectric devices or thermal transducers, such as resistors. The printheads have a plurality of inkjet ejectors that are fluidly connected at one end to an ink supplying manifold through an ink channel and at another end to an aperture in an aperture plate. The ink drops are ejected through the apertures, which are sometimes called nozzles.

In a typical piezoelectric inkjet printing system, application of an electrical signal to a piezoelectric transducer causes the transducer to expand. This expansion pushes a diaphragm, which is positioned adjacent the transducer, into a pressure chamber filled with ink received from the manifold. The diaphragm movement urges ink out of the pressure chamber and through the aperture to eject liquid ink drops. The ejected drops, referred to as pixels, land on an image receiving member opposite the printhead to form an ink image. The respective channels from which the ink drops were ejected are refilled through the ink channel from an ink manifold.

In some phase change or solid ink printers, which use an indirect printing process, the image receiving member is a rotating drum or belt coated with a release agent and the ink is a phase change material that is normally solid at room temperature. In these solid ink printers, the ink image is transferred from the rotating image receiving member to a recording medium, such as paper. The transfer is generally conducted in a nip formed by the rotating image receiving member and a rotating pressure roller, which is also called a transfix roller. One or both of the transfix roller and the recording medium may be heated prior to the recording medium entry in the transfixing nip. As a sheet of paper is transported through the nip, the fully formed image is transferred from the image receiving member and fixed on the sheet of paper. This technique of using heat and pressure at a nip to transfer and fix an image to a recording medium passing through the nip is typically known as "transfixing," a well-known term in the art, particularly with solid ink technology.

During printing operations, phase change inks are heated to melt a solid ink into a liquid form for ejection by the inkjet ejectors. The phase change inks melt when heated above a predetermined melting temperature that is determined by the chemical formulation of the solid ink. One or more heaters in the printer heat the surface of the image receiving member so that ink drops on the imaging drum remain in a visoelastic state prior to being transfixed onto the media sheet. A typical embodiment of a heater is an electric heater that heats the surface of the image receiving member in response to an electrical current being passed through the heater. The image receiving member is configured as a rotating drum that is heated to an average temperature of approximately 60° C. prior to receiving ink drops that form latent ink images for printing.

At various times, the image receiving members in indirect solid ink printers may cool to a temperature that is below the operating temperature that enables the image receiving member to facilitate transfer of ink images from the receiving member to a media sheet. For example, if the printer is turned off, the heater is deactivated and the temperature of the image receiving member drops to the ambient temperature of the environment surrounding the printer. Modern printers also include power saving modes that deactivate heaters and other components when the printer is not in use to reduce the consumption of electrical power.

When a printer with a "cold" image receiving member receives a print job, a controller activates the heater to enable the temperature of the image receiving member to rise to a predetermined operating temperature before the ink ejectors eject in drops onto the image receiving member to form ink images. The amount of time taken to heat the image receiving member to the operating temperature results in a delay from the time that the printer receives a print job to the time that the printer produces the first printed page. In one common scenario, a printer with a "cold" image receiving member receives a print job that includes a small number of printed pages (e.g. one or two pages). The amount of time required to heat the image receiving member to the operating temperature represents a substantial portion of the total time taken to execute print jobs with a small number of pages. Consequently, improvements to the operation of indirect inkjet printers that reduce the amount of time that is needed to commence printing when the printer has a "cold" image receiving member would be beneficial.

SUMMARY

In one embodiment, a method for operating an image receiving member in a printer has been developed. The method includes activating a heater to direct heat onto a portion of an image receiving member, and selectively rotating the image receiving member past the heater to heat a first portion of the image receiving member to a first predetermined temperature that is greater than a second temperature to which a remaining portion of the image receiving member is heated by the heater.

In another embodiment, an inkjet printer has been developed. The printer includes an image receiving member, an actuator configured to rotate the image receiving member, a heater configured to heat a portion of the image receiving member, a plurality of ink ejectors configured to eject ink drops onto the surface of the image receiving member, and a controller operatively connected to the actuator, the heater, and the plurality of ink ejectors, the controller being configured to activate the heater to direct heat onto a portion of the image receiving member, operate the actuator to rotate the image receiving member selectively past the heater to heat a first portion of the image receiving member to a first predetermined temperature that is greater than a second temperature to which a remaining portion of the image receiving member is heated by the heater.

DETAILED DESCRIPTION

Figure 1:
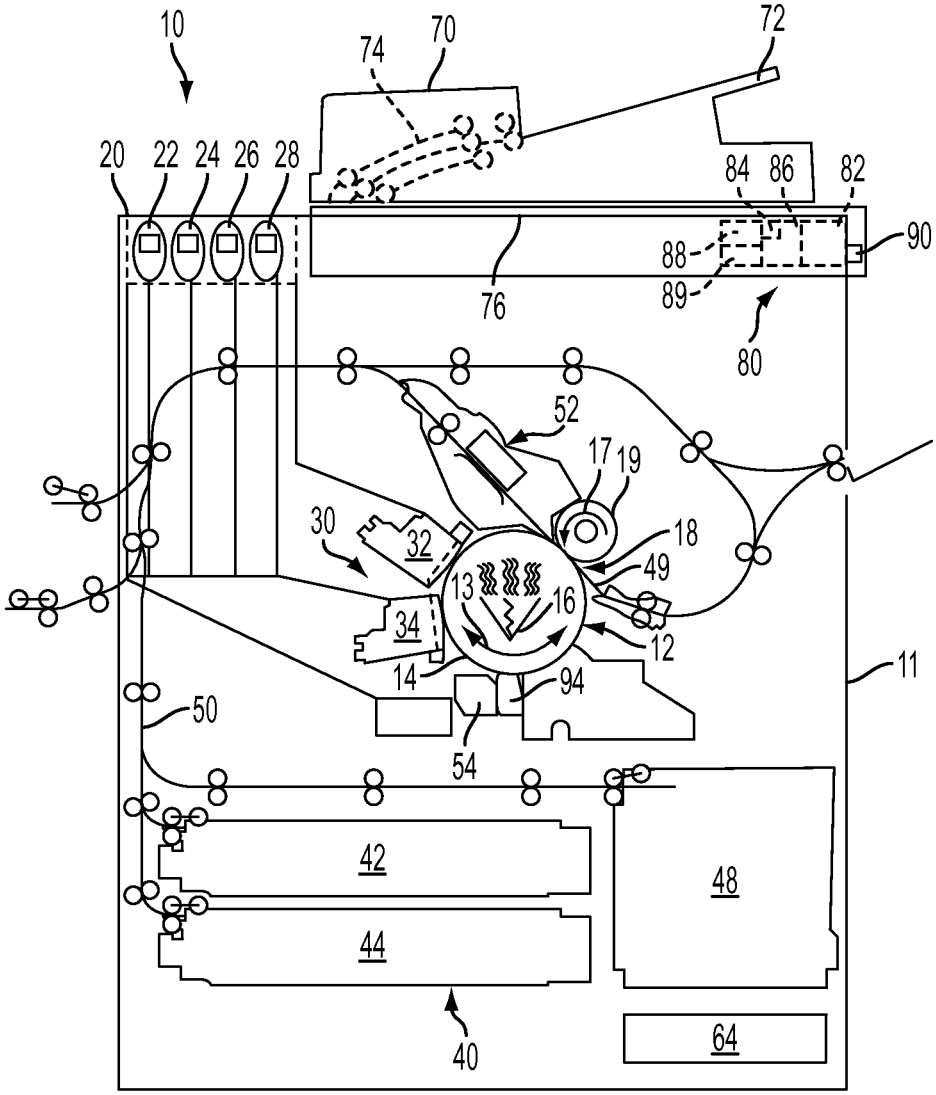
FIG. 1 is a schematic diagram of a printing device that is configured to use phase change ink.

For a general understanding of the environment for the system and method disclosed herein as well as the details for the system and method, reference is made to the drawings. In the drawings, like reference numerals have been used throughout to designate like elements. As used herein the term "printer" refers to any device that is configured to eject a marking agent upon an image receiving member and include photocopiers, facsimile machines, multifunction devices, as well as direct and indirect inkjet printers that are configured to use phase-change, aqueous, solvent-based, or UV curable inks and the like.

The terms "phase change ink" and "solid ink" are interchangeably used in this document and refer to inks that are in a solid state at room temperature and melt when heated above a predetermined melting temperature. A solid ink printer is configured to receive phase change ink in solid form, such as ink sticks or ink pastilles, and to apply heat to melt the ink into a liquid form. The liquid ink is ejected from a plurality of ink ejectors in the form of drops to form ink images. The term "ink image" refers to any pattern of ink, including text and graphics, which the printer forms on a media sheet.

As used herein, the term "heater" refers to any device that is configured to generate heat, including electrical heaters incorporating one or more electrically resistive heating elements. As used herein the terms "activate" and "deactivate" when used with reference to a heater refer to operating modes of the heater. An activated heater generates an amount of heat sufficient to raise the temperature of at least one printer component such as an image receiving member to an operating temperature that enables the printer component to operate in forming ink images on print media. A deactivated heater may generate no additional heat, or may generate heat that elevates the temperature of the coupled printer components to a temperature that is less than the operating temperature that enables the printer to produce, house, or eject liquid ink.

As used herein the term "print job" refers to data that are sent to a printer to specify commands and image data corresponding to one or more images for the printer to generate. Each image may include various elements, such as text, graphics, image quality, and the type of media to which the printer prints the ink images. A print job may further include image data that specifies colors that correspond to one or more ink colors for use in generating the images. The printer forms images and performs various actions in accordance with data and commands in the print job to execute the print job.

FIG. 1 depicts an embodiment of a printer 10 including an image receiving member 12 that is heated by an internal heater 16. As illustrated, the printer 10 includes a frame 11 to which is mounted directly or indirectly all its operating subsystems and components, as described below. The phase change ink printer 10 includes an image receiving member 12 that is shown in the form of a rotatable imaging drum, but can equally be in the form of a supported endless belt. The imaging drum 12 has an image receiving surface 14 on which phase change ink images are formed. An actuator 94, such as a servo or electric motor, engages the image receiving member 12 and is configured to rotate the image receiving member bi-directionally as indicated by arrows 13. A transfix roller 19 rotatable in the direction 17 is loaded against the surface 14 of drum 12 to form a transfix nip 18 within which ink images formed on the surface 14 are transfixed onto a heated media sheet 49. An electrical power supply 64 provides electrical power to the various electronic and electromechanical components in the printer 10. In one embodiment, electrical power supply 64 converts an alternating current (AC) electrical current into one or more direct current (DC) electrical currents having various voltage and current levels.

Operation and control of the various subsystems, components and functions of the printer 10 are performed with the aid of a controller or electronic subsystem (ESS) 80. The ESS or controller 80, for example, is a self-contained, dedicated mini-computer having a central processor unit (CPU) 82 with electronic storage 84, and a display or user interface (UI) 86. The ESS or controller 80, for example, includes a sensor input and control circuit 88 as well as an ink drop placement and control circuit 89. A temperature sensor 54 is operatively connected to the controller 80. The temperature sensor 54 is configured to measure the temperature of the image receiving member surface 14 as the image receiving member 12 rotates past the temperature sensor 54. In one embodiment, the temperature sensor is a thermistor that is configured to measure the temperature of a selected portion of the image receiving member 12. The controller 80 receives data from the temperature sensor and is configured to identify the temperatures of one or more portions of the surface 14 of the image receiving member 12. In addition, the CPU 82 reads, captures, prepares and manages the image data flow associated with print jobs received from image input sources, such as the scanning system 76, or an online or a work station connection 90. As such, the ESS or controller 80 is the main multi-tasking processor for operating and controlling all of the other printer subsystems and functions.

The controller 80 may be implemented with general or specialized programmable processors that execute programmed instructions, for example, printhead operation. The instructions and data required to perform the programmed functions may be stored in memory associated with the processors or controllers. The processors, their memories, and interface circuitry configure the controllers to perform the processes, described more fully below, that enable the imaging member to reach a temperature at which at least a portion of the imaging member is available for ink image formation. These components may be provided on a printed circuit card or provided as a circuit in an application specific integrated circuit (ASIC). Each of the circuits may be implemented with a separate processor or multiple circuits may be implemented on the same processor. Alternatively, the circuits may be implemented with discrete components or circuits provided in VLSI circuits. Also, the circuits described herein may be implemented with a combination of processors, ASICs, discrete components, or VLSI circuits.

The phase change ink printer 10 also includes a phase change ink delivery subsystem 20 that has multiple sources of different color phase change inks in solid form. Since the phase change ink printer 10 is a multicolor printer, the ink delivery subsystem 20 includes four (4) sources 22, 24, 26, 28, representing four (4) different colors CMYK (cyan, magenta, yellow, and black) of phase change inks. The phase change ink delivery subsystem also includes a melting and control apparatus (not shown) for melting or phase changing the solid form of the phase change ink into a liquid form. Each of the ink sources 22, 24, 26, and 28 includes a reservoir used to supply the melted ink to the printhead assemblies 32 and 34. In the example of FIG. 1, ink source 28 supplies ink to a single-color printhead assembly 32.

The phase change ink printer 10 includes a substrate supply and handling subsystem 40. The substrate supply and handling subsystem 40, for example, may include sheet or substrate supply sources 42, 44, 48, of which supply source 48, for example, is a high capacity paper supply or feeder for storing and supplying image receiving substrates in the form of cut sheets 49, for example. The substrate supply and handling subsystem 40 also includes a substrate handling and treatment subsystem 50 that has a substrate heater or preheater assembly 52. The phase change ink printer 10 as shown may also include an original document feeder 70 that has a document holding tray 72, document sheet feeding and retrieval devices 74, and a document exposure and scanning subsystem 76.

In operation, the printer 10 receives a print job containing image data for one or more images from either the scanning subsystem 76 or via the online or work station connection 90. Prior to forming ink images on the image receiving member 12, the controller 80 identifies the operating temperature of the surface 14 of the image receiving member 12. In the embodiment of printer 10, the operating temperature range of the image receiving member 12 is between 55° C. and 65° C. In some embodiments, the image receiving member can operate at lower temperatures, such as 45° C.-50° C., if the image receiving member rotates at a lower than normal rate during the transfix process. If the operating temperature is below a predetermined temperature range, the controller 80 activates the heater 16. The heater 16 is a directional heater that directs heat to a portion of the image receiving member surface 14. The controller 80 rotates the image receiving member 12 to heat a portion of the surface of the image receiving member to an operating temperature. The portion of the surface of the image receiving member that is heated is large enough to accommodate one pitch, or page-sized latent ink image. In a common two-pitch printing system approximately one-half of the image receiving surface 14 is heated. The time required to heat a single-pitch portion of the image receiving member 12 is substantially lower than the time required to heat the entire image receiving member 12 to the operating temperature, and the printer 10 is configured to print using a low throughput print mode once the portion of the image receiving member is heated to the operating temperature.

Media sources 42, 44, 48 provide image receiving substrates that pass through substrate treatment system 50 to arrive at transfix nip 18 formed between the image receiving member 12 and transfix roller 19 in timed registration with the ink image formed on the image receiving surface 14. As the ink image and media travel through the nip, the ink image is transferred from the surface 14 and fixedly fused to the image substrate within the transfix nip 18. After completion of all received print jobs and expiration of a time period, controller 80 is configured to deactivate the heater 16 in accordance with a standby operating mode.

Figure 2:
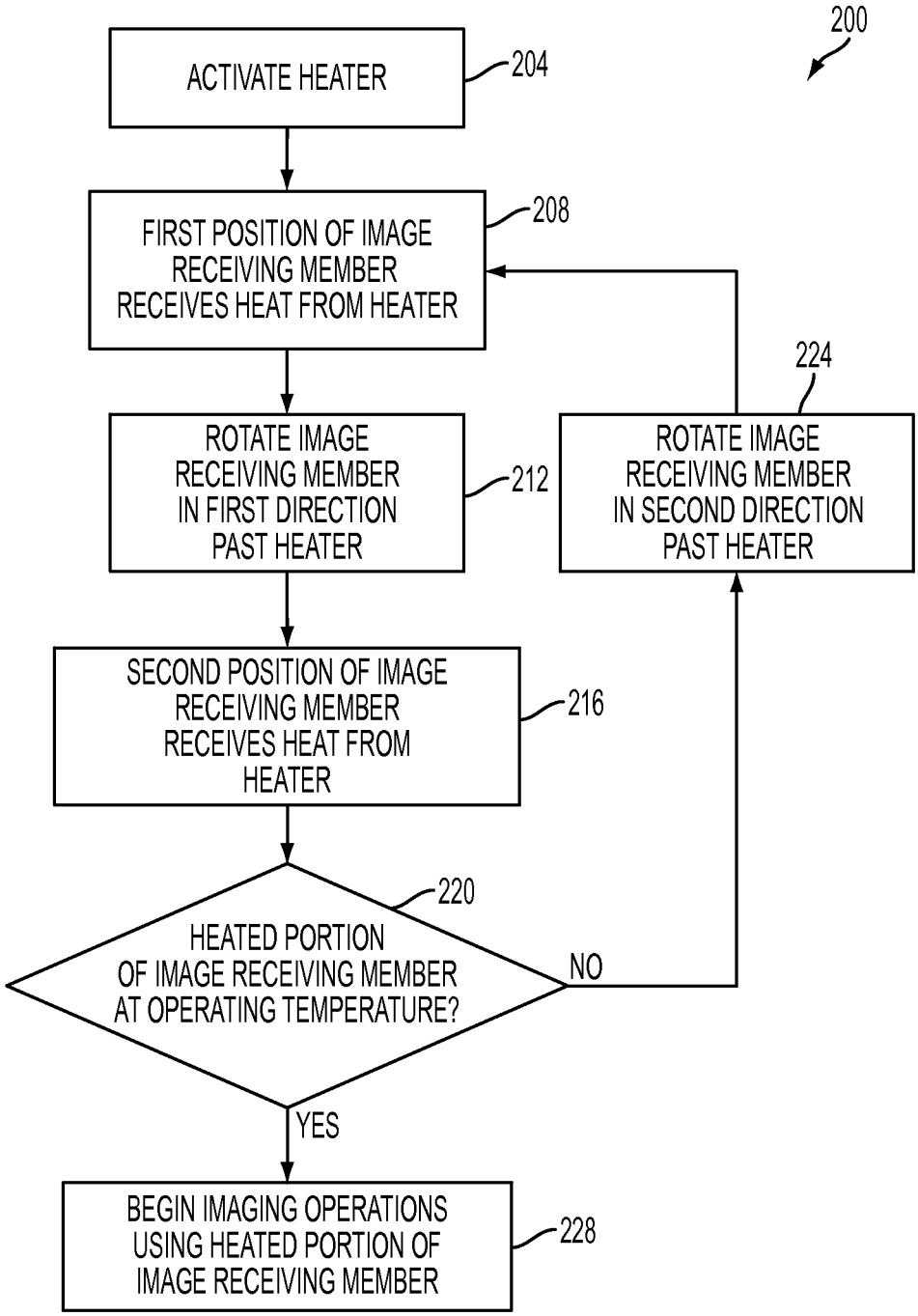
FIG. 2 is a block diagram of a process for heating a portion of an image receiving member in a phase change ink printing device.

FIG. 2 depicts a process 200 for heating a selected portion of an image receiving member. Process 200 is described with reference to the printer 10 of FIG. 1 and FIG. 4A by way of example. Process 200 begins by activating a heater to heat a portion of the image receiving member (block 204). In one embodiment, the heater is an electrical heater that activates in response to a flow of electrical current through one or more heating elements in the heater. In the printer 10, the heater 16 is positioned inside of the image receiving member 12. As seen in more detail in FIG. 4A and FIG. 4B, the heater 16 includes a heating element 408 and reflectors 412. The heating element 408 receives electrical current from the electrical power supply 64 and the reflectors 412 reflect the thermal energy from the heating element 408 toward a portion of the image receiving member 12. Exemplary embodiments of the reflectors 412 include metallic or ceramic plates. The image receiving member 12 is configured to rotate, while the heater 16 remains in a fixed position. Thus, rotation of a selected portion of the image receiving member past the heater results in directed radiant energy from the heater 16 heating the selected portion of the image receiving member 12. While the heater 16 is positioned within the image receiving member 12, alternative heater configurations include one or more heaters that are positioned outside of the image receiving member and direct radiant energy toward the outer surface of the image receiving member.

Figure 4A:
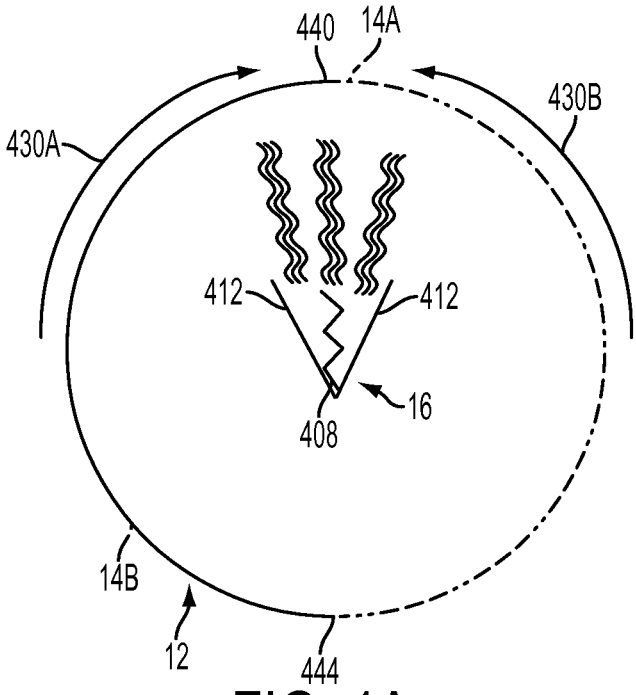
FIG. 4A is a schematic diagram of an image receiving member and a heater that heats the image receiving member using the process of FIG. 2.

The activated heater 16 heats a first position of the image receiving member 12 (block 208). The portion of the image receiving member 12 that receives directed heat from the heater 16 is typically too small to hold an ink image for normal printing. To heat a larger portion of the image receiving member 12, an actuator such as actuator 94 rotates the image receiving member 12 past the heater in a first direction (block 212). The portion of the image receiving member 12 that rotates past the heater 16 increases in temperature. The image receiving member 12 rotates until reaching a predetermined second position (block 216). The first position and the second position of the image receiving member form two ends of a heated portion of the image receiving member. As seen in FIG. 4A, the heater 16 is directing radiant energy toward a first position 440 of the image receiving member 12. The image receiving member 12 rotates in a counterclockwise direction 430A to pass a heated portion 14A of the image receiving member 12 past the heater 16. The image receiving member 12 rotates until a second position 444 at the opposite end of the heated portion 14A is positioned to receive radiant energy from the heater 16.

If the surface temperature of the heated portion 14A of the image receiving member 12 remains below the accepted operating temperature (block 220) then the actuator 94 rotates the image receiving member 12 in the opposite direction, such as direction 430B (block 224). The temperature measurement in block 220 is performed with a thermal sensor, such as the temperature sensor 54, which measures the temperature of the heated portion 14A of the image receiving member. In some configurations, process 200 measures the temperature of the heated portion 14A continuously. Process 200 performs blocks 208-224 to rotate the image receiving member in a bi-directional manner until the temperature of the heated portion of the image receiving member 12 has reached an operating temperature. Once the heated portion of the image receiving member 12 has reached the operating temperature (block 220), the printer commences imaging operations using the heated portions of the image receiving member (block 228).

Figure 3:
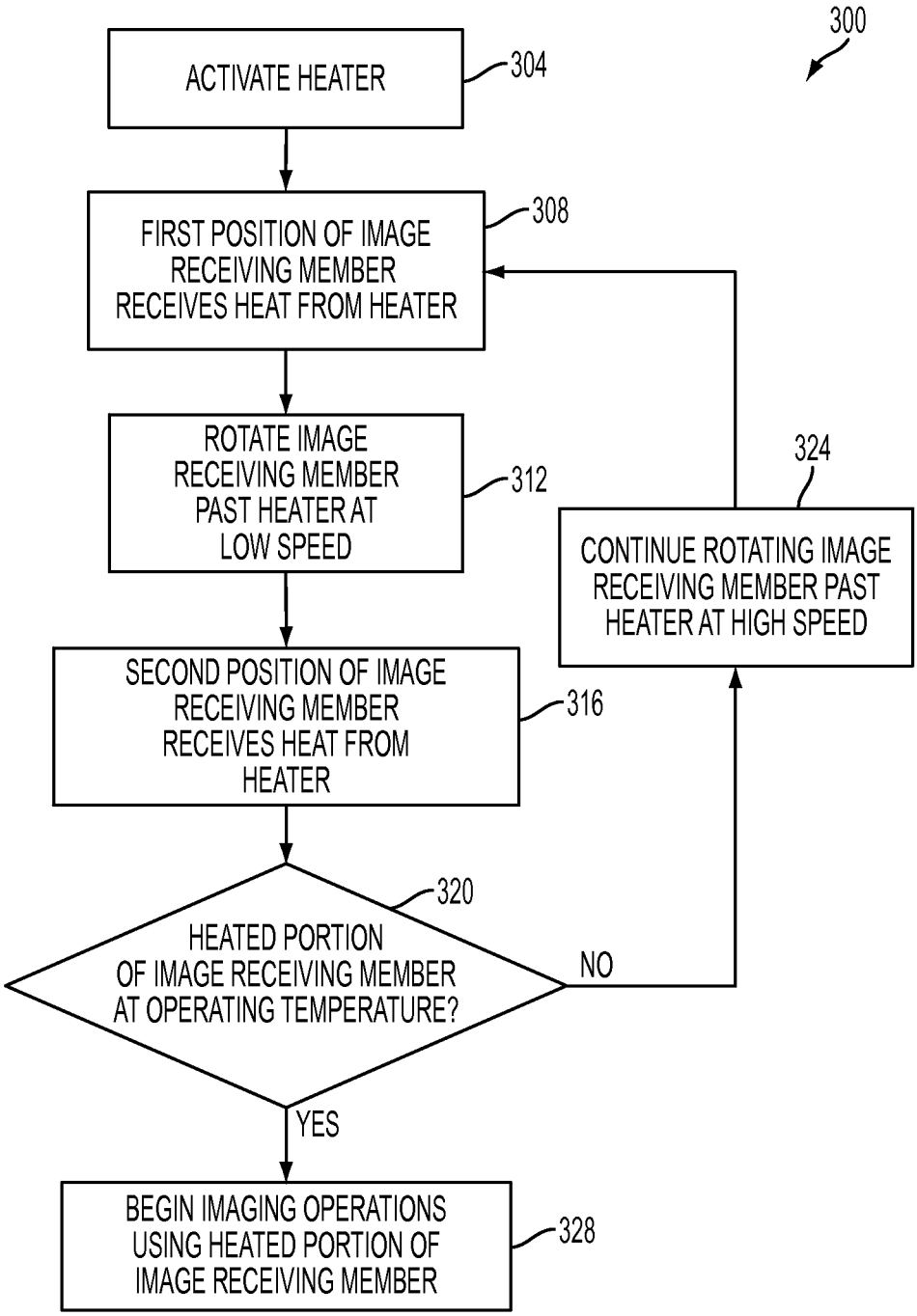
FIG. 3 is a block diagram of another process for heating a portion of an image receiving member in a phase change ink printing device.

FIG. 3 depicts an alternative process 300 for heating a portion of an image receiving member. Process 300 is described with reference to the printer 10 of FIG. 1 and FIG. 4B by way of example. Process 300 begins by activating the heater 16 to heat a portion of the image receiving member 12 (block 304). A first position 440 of the image receiving member 12 receives radiant heat from the heater 16. The actuator 94 rotates the image receiving member 12 at a low rotational speed in direction 434A (block 308). In one embodiment, the low rotational speed is approximately 0.5 to 5 inches per second. A portion 14A of the image receiving member 12 receives heat as the image receiving member rotates past the heater 16. The image receiving member 12 rotates at the low speed until a second end 444 of the heated portion 14A passes the heater 16.

Figure 4B:
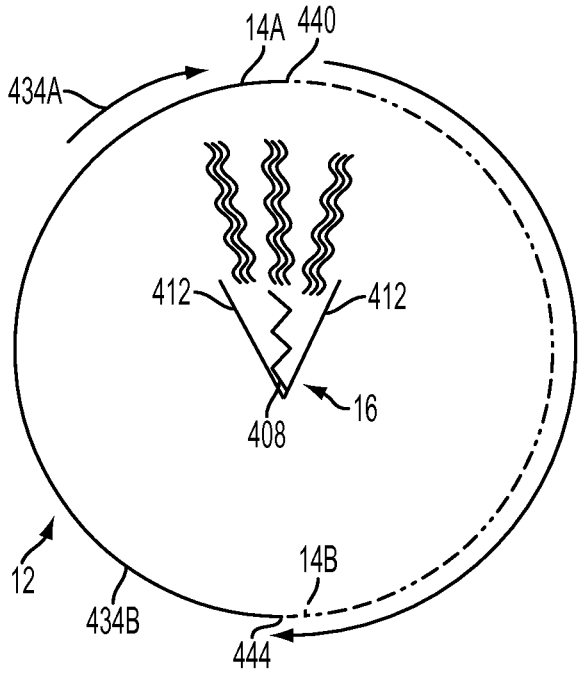
FIG. 4B is a schematic diagram of an image receiving member and a heater that heats the image receiving member using the process of FIG. 3.

If the heated portion 14A of the image receiving member is below a predetermined operating temperature (block 320), the actuator 94 accelerates the remaining portion 14B of the image receiving member past the heater 16 at a higher speed (block 324). The temperature measurement in block 220 is performed with the temperature sensor 54 that measures the temperature of the heated portion 14A of the image receiving member. In some configurations, process 300 measures the temperature of the heated portion 14A continuously. As seen in FIG. 4B, the remaining portion 14B continues to rotate in direction 434A, but at a higher speed past the heater 16. In one embodiment, the higher rotational speed is approximately 20 to 30 inches a second. The remaining portion 14B absorbs a comparatively small amount of radiant energy during the high speed rotation. The actuator 94 returns the image receiving member 12 to the low rate of rotation when the first end 440 of the heated portion 14A of the image receiving member passes the heater 16 (block 308). Process 300 performs block 308-324 until the temperature of the heated portion of the image receiving member 12 has reached the predetermined operating temperature. Once the heated portion of the image receiving member 12 has reached the operating temperature (block 320), the printer commences imaging operations using the heated portions of the image receiving member (block 328).

Figure 5:
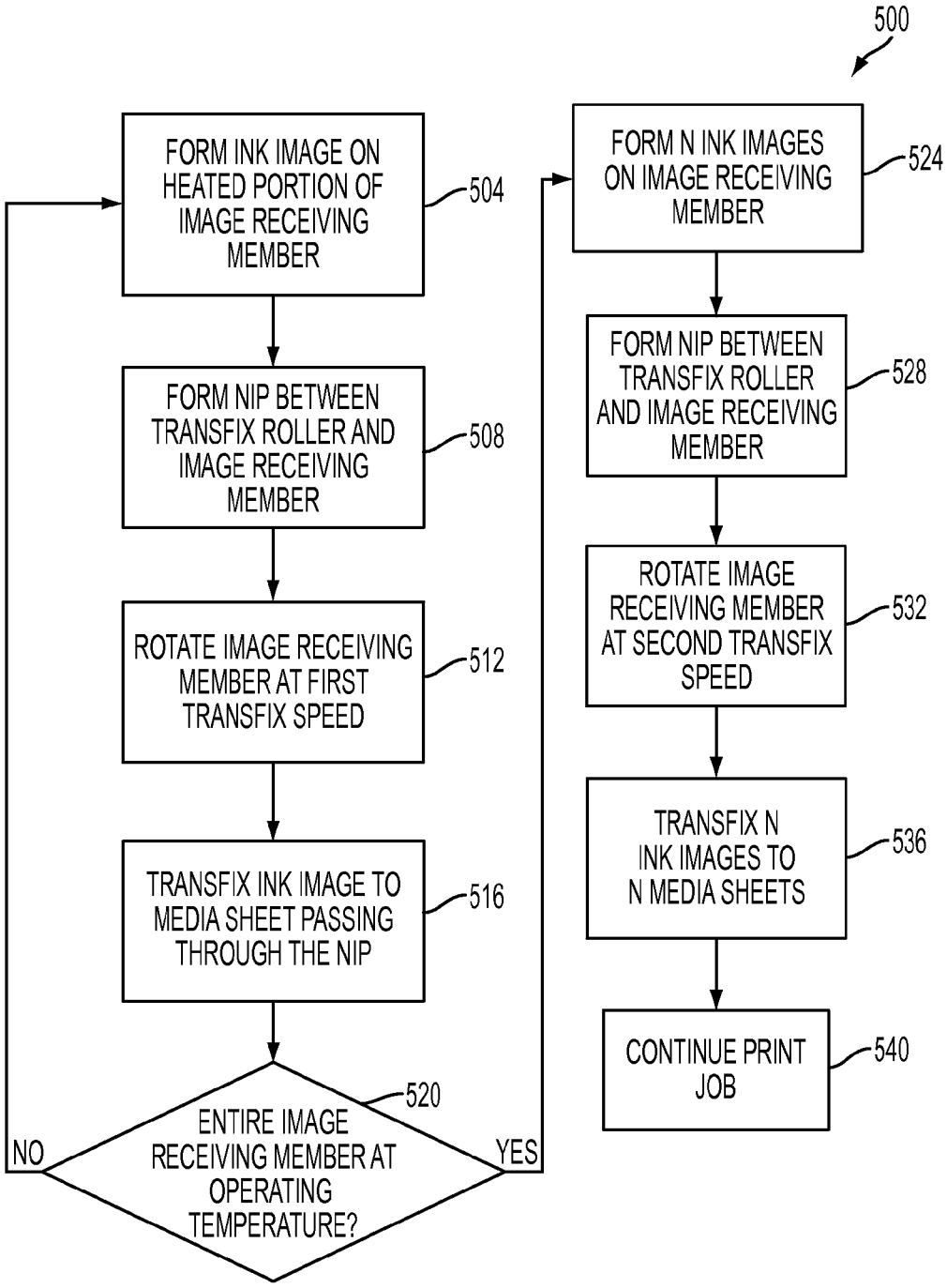
FIG. 5 is a block diagram of a process for operating a solid-ink printing device.

As describe above, both process 200 and process 300 are configured to heat a portion of the image receiving member to an operating temperature. In some embodiments, the value of the operating temperature can be selected based on data received as part of a print job request. For example, a print job often includes one or more image quality parameters that specify a selected quality of images generated by the printer. In the embodiment of printer 10, the higher quality print jobs operate with the heated portion 14A of the image receiving member 12 at an operating temperature range of 55° C.-65° C. For a print job having a printing parameter that specifies a higher quality output, processes 200 and 300 heats the portion 14A of the image receiving member 12 to the specified operating temperature. For print jobs that have a lower image quality job parameter, the processes 200 and 300 heat the portion of the image receiving member 12 to a lower operating temperature range of, for example, 45° C.-50° C. The heating process for a lower quality print job completes in comparatively less time that the heating process for a higher quality image. Various printer embodiments select the operating temperature for processes 200 and 300 using other print job parameters including the type of print media and the total image area coverage that specifies the proportion of the media page that is covered in ink FIG. 5 depicts a process 500 for imaging operations of an imaging device with a partially heated image receiving member. Some printer embodiments perform process 500 after heating a portion of an image receiving member to an operating temperature using process 200 or process 300. Process 500 is described with reference to the printer 10 of FIG. 1 by way of example. Process 500 begins by forming an ink image on the heated portion of the image receiving member (block 504). In printer 10, the image receiving member rotates past the printhead assemblies 32 and 34. Ink ejectors in the printhead assemblies 32 and 34 eject liquid ink drops onto the heated portion of the surface 14 of the rotating image receiving member 12 to form an ink image. As described above, the ink drops ejected from the printhead assemblies 32 and 34 are heated to remain in a viscoelastic state during the printing process. The heated portion of the image receiving member 12 maintains the temperature of the ink drops after the ink drops are ejected from the printhead assemblies 32 and 34 and prior to transfixing the ink image to a media sheet.

Once the ink image is formed on the image receiving member 12, the transfix roller 19 engages the image receiving member 12 to form a transfix nip 18 (block 508). The actuator 94 rotates the image receiving member 12 at a first transfix rotational speed (block 512). In embodiments where the operating temperature of the heated portion of the image receiving member is lower than the operating temperature of a fully heated image receiving member, the image receiving member may rotate at a lower transfix rotational speed. For example, in the printer 10 if the heated portion 14A of the image receiving member 12 is heated to approximately 45° C. while the normal operating temperature of the fully heated image receiving member 12 is approximately 55-60° C., then the image receiving member 12 rotates at a lower speed during the transfix operation. A media sheet passes through the transfix nip as the heated portion of the image receiving member 12 bearing the ink image passes through the transfix nip. The heat and pressure generated at the transfix nip 18 transfers the ink image from the image receiving member to the media sheet (block 516).

During the processing performed in blocks 504-516, the heater continues to apply heat to the image receiving member. The heater maintains the operating temperature of the heated portion of the image receiving member, and also applies heat to the remaining portion. For print jobs having a small number of pages, the entire print job may be completed before the entire image receiving member reaches the operating temperature. While the overall rate of printing pages is lower when using only a portion of the image receiving member to transfix pages, the time required to fully heat the image receiving forms a substantial portion of the delay between startup of the printer the time at which the printer produces the first printed page. Thus, processes 200, 300 and 500 enable the printer to execute smaller print jobs in less total time. In the case of larger print jobs, the imaging operations of blocks 504-516 continues until the entire image receiving member has reached the operating temperature (block 520).

When the entire surface 14 of the image receiving member 12 reaches the operating temperature (block 520), the imaging operations of the process 500 continue using the entire image receiving member instead of only using the heated portion of the image receiving member. In the printer 10, the image receiving member is a two pitch image receiving member that is configured to hold two ink images for two different media pages simultaneously. Process 500 is also suitable for use with image receiving member embodiments that are configured to hold three or more (N) pitches. The printer 10 rotates the image receiving member past the printhead assemblies 32 and 34, and the printhead assemblies eject ink drops onto the rotating image receiving member to form the N ink images on the image receiving member (block 524). The transfix roller 19 engages the image receiving member 12 to form the transfix nip 18 (block 528). The image receiving member 12 is rotated at a second transfix speed (block 532) and N media sheets pass through the transfix nip 18 to transfix the N ink images (block 536). In some printer embodiments, the second transfix rotational speed of block 532 is greater than the first transfix rotational speed of block 512 because the entire image receiving member 12 is heated to the operating temperature. The printer 10 continues the print job as described in blocks 524-536 until the print job is completed (block 540).

The above description relates to two velocity profiles useful for heating a portion of an imaging member to an operational temperature. One profile operates the imaging member in a forward and reverse rotation while the other uses slow rotational movement followed by fast rotation rotational movement. Other profiles that are consonant with the principles of the present invention are also useful. For example, the temperature measurements obtained from the signals generated by the temperature sensor(s) can be used as feedback for the type of velocity profile being used to enable changes to be made. One example would be the use of the forward and reverse profile and then changing to the alternating rotational speed in the same direction profile with reference to the temperature measurements. Other changes in the velocity profiles are also possible and still be consonant with the principles described herein.

It will be appreciated that variants of the above-disclosed and other features, and functions, or alternatives thereof, may be desirably combined into many other different systems or applications. Various presently unforeseen or unanticipated alternatives, modifications, variations, or improvements therein may be subsequently made by those skilled in the art, which are also intended to be encompassed by the following claims.

We claim:

1. A method of operating an image receiving member in a printer comprising:

activating a heater to direct heat onto a portion of an image receiving member; and selectively rotating the image receiving member past the heater to heat a first portion of the image receiving member to a first predetermined temperature that is greater than a second temperature to which a remaining portion of the image receiving member is heated by the heater.

2. The method of claim 1, the selective rotation of the image receiving member further comprising:

bi-directionally rotating the image receiving member to maintain the first portion of the image receiving member at a position that enables the first portion of the image receiving member to be heated by the heater.

3. The method of claim 1, the selective rotation of the image receiving member further comprising:

rotating the image receiving member at a first rotational rate as the first portion of the image receiving member passes the heater; and rotating the remaining portion of the image receiving member at a second rotational rate as the remaining portion of the image receiving member passes the heater, the second rotational rate being greater than the first rotational rate.

4. The method of claim 1 further comprising:

operating a plurality of ink ejectors to form an ink image on the first portion of the rotating image receiving member;

engaging a transfix roller with the rotating image receiving member to form a nip; and rotating the first portion of the image receiving member through the nip at a first predetermined transfix rotational rate as a print medium passes through the nip to transfer the ink image from the image receiving member to the print medium.

5. The method of claim 4, the operating of the plurality of ink ejectors further comprising:

ejecting liquid drops of a phase-change ink to form the ink image on the first portion of the image receiving member.

6. The method of claim 4 further comprising:

continuing to rotate the image receiving member selectively past the heater until a temperature of the remaining portion of the image receiving member reaches a second predetermined temperature;

operating the plurality of ink ejectors to form a second ink image on the first portion of the rotating image receiving member as the first portion passes the plurality of inkjet ejectors;

operating the plurality of ink ejectors to form a third ink image on the remaining portion of the rotating image receiving member as the remaining portion passes the plurality of inkjet ejectors;

engaging the transfix roller with the rotating image receiving member to form the nip;

rotating the first portion of the image receiving member through the nip at a second predetermined transfix rotational rate as a second print medium passes through the nip to transfer the second ink image from the image receiving member to a second print medium; and rotating the remaining portion of the image receiving member through the nip at the second predetermined transfix rotational rate as a third print medium passes through the nip to transfer the third ink image from the image receiving member to the third print medium.

7. The method of claim 6, the second predetermined temperature being greater than the first predetermined temperature.

8. The method of claim 6, the second transfix rotational rate being greater than the first transfix rotational rate.

9. The method of claim 1, the image receiving member being selectively rotated past the heater to heat the first portion of the image receiving member in response to a print job parameter having a predetermined value.

10. The method of claim 9, the predetermined print job parameter being a print media type parameter.

11. The method of claim 9, the predetermined print job parameter being an image quality parameter.

12. The method of claim 9, the predetermined print job parameter being an image area coverage parameter.

13. A printer comprising:

an image receiving member;

an actuator configured to rotate the image receiving member;

a heater configured to heat a portion of the image receiving member;

a plurality of ink ejectors configured to eject ink drops onto the surface of the image receiving member; and a controller operatively connected to the actuator, the heater, and the plurality of ink ejectors, the controller being configured to:

activate the heater to direct heat onto a portion of the image receiving member;

operate the actuator to rotate the image receiving member selectively past the heater to heat a first portion of the image receiving member to a first predetermined temperature that is greater than a second temperature to which a remaining portion of the image receiving member is heated by the heater.

14. The printer of claim 13, the controller being further configured to:

operate the actuator to bi-directionally rotate the image receiving member to maintain the first portion of the image receiving member at a position that enables the first portion of the image receiving member to be heated by the heater.

15. The printer of claim 13, the controller being further configured to:

operate the actuator to rotate the image receiving member at a first rotational rate as the first portion of the image receiving member passes the heater; and operate the actuator to rotate the remaining portion of the image receiving member at a second rotational rate as the remaining portion of the image receiving member passes the heater, the second rotational rate being greater than the first rotational rate.

16. The printer of claim 13 further comprising:

a transfix roller; and the controller being operatively connected to the transfix roller and further configured to:

operate the plurality of ink ejectors to form an ink image on the first portion of the rotating image receiving member;

engage the transfix roller with the rotating image receiving member to form a nip; and operate the actuator to rotate the first portion of the image receiving member through the nip at a first predetermined transfix rotational rate as a print medium passes through the nip to transfer the ink image from the image receiving member to the print medium.

17. The printer of claim 16, the plurality of ink ejectors being configured to eject liquid drops of a phase-change ink to form the ink image on the first portion of the image receiving member.

18. The printer of claim 16, the controller being further configured to:

continue operation of the actuator to rotate the image receiving member selectively past the heater until a temperature of the remaining portion of the image receiving member reaches a second predetermined temperature;

operate the plurality of ink ejectors to form a second ink image on the first portion of the rotating image receiving member as the first portion passes the plurality of inkjet ejectors;

operate the plurality of ink ejectors to form a third ink image on the remaining portion of the rotating image receiving member as the remaining portion passes the plurality of inkjet ejectors;

operate the transfix roller to engage the rotating image receiving member to form the nip;

operate the actuator to rotate the first portion of the image receiving member through the nip at a second predetermined transfix rotational rate as a second print medium passes through the nip to transfer the second ink image from the image receiving member to a second print medium; and operate the actuator to rotate the remaining portion of the image receiving member through the nip at the second predetermined transfix rotational rate as a third print medium passes through the nip to transfer the third ink image from the image receiving member to the third print medium.

19. The printer of claim 18, the second predetermined temperature being greater than the first predetermined temperature.

20. The printer of claim 18, the second transfix rotational rate being greater than the first transfix rotational rate.

21. The printer of claim 13, controller being configured to operate the actuator to rotate the image receiving member selectively past the heater to heat the first portion of the image receiving member in response to a print job parameter having a predetermined value.

22. The printer of claim 21, the predetermined print job parameter being a print media type parameter.

23. The printer of claim 21, the predetermined print job parameter being an image quality parameter.

24. The printer of claim 21, the predetermined print job parameter being an image area coverage parameter.

* * * * *